US006614345B2

(12) United States Patent
Kimata et al.

(10) Patent No.: US 6,614,345 B2
(45) Date of Patent: Sep. 2, 2003

(54) OIL PRESSURE WARNING SYSTEM FOR OUTBOARD MOTOR

(75) Inventors: Ryuichi Kimata, Wako (JP); Kazuhiro Satou, Wako (JP); Sadafumi Shidara, Wako (JP); Nobuhiro Takahashi, Takanezawa-machi (JP)

(73) Assignees: Honda Giken Kogyo Kabushiki Kaisha, Tokyo (JP); Keihin Corporation, Tokyo (JP)

( * ) Notice: Subject to any disclaimer, the term of this patent is extended or adjusted under 35 U.S.C. 154(b) by 0 days.

(21) Appl. No.: 09/939,828

(22) Filed: Aug. 28, 2001

(65) Prior Publication Data

US 2002/0067251 A1 Jun. 6, 2002

(30) Foreign Application Priority Data

Aug. 30, 2000 (JP) ..... 2000-260784

(51) Int. Cl.[7] ..... B60Q 1/00

(52) U.S. Cl. ..... 340/450.3; 340/451; 340/441; 340/439; 123/196 CP

(58) Field of Search ..... 340/450.3, 451, 340/501, 450.5, 450.1, 441, 439, 459–462; 123/196, 27 A, 196 CP, 198 P

(56) References Cited

U.S. PATENT DOCUMENTS 3,927,390 A * 12/1975 Hill ..... 340/60
4,019,489 A * 4/1977 Cartmill ..... 123/198
4,102,316 A * 7/1978 Valbert ..... 123/198
4,166,442 A * 9/1979 Henderson et al. ..... 123/198
4,328,480 A * 5/1982 Keitel et al. ..... 340/60
4,768,471 A * 9/1988 Draxler et al. ..... 123/41.15
6,111,499 A * 8/2000 Morikami ..... 340/450.3
6,213,820 B1 * 4/2001 Kanno ..... 440/1

* cited by examiner

*Primary Examiner*—Daniel J. Wu
*Assistant Examiner*—Son Tang

(57) ABSTRACT

An oil pressure warning system for an outboard motor for detecting and alarming an abnormal oil pressure of an internal combustion engine, the system including a first oil pressure switch which generates an ON signal when the oil pressure is less than or equal to a first predetermined oil pressure, and a second oil pressure switch which generates an ON signal the oil pressure is less than or equal to a second predetermined oil pressure set higher than the first predetermined oil pressure. The abnormality of oil pressure is detected and alarmed based on the ON signal of the switches. The first and second predetermined oil pressures are determined based on an oil pressure characteristic of a (possible) maximum oil temperature (under which the engine has been warmed up) set relative to the engine speed, thereby ensuring to detect and alarm the abnormality of oil pressure under any engine speed and any oil temperature.

22 Claims, 11 Drawing Sheets

OIL PRESSURE WARNING SYSTEM FOR OUTBOARD MOTOR

BACKGROUND OF THE INVENTION

Field of the Invention

This invention relates to an oil pressure warning system for an outboard motor, particularly to an oil pressure warning system for detecting (determining) and warning of the occurrence of an abnormality in lubricant properties, such as excessive low pressure of engine oil in an internal combustion engine for an outboard motor for small boats.

Description of the Related Art

A conventional oil pressure warning system for an outboard motor has an oil pressure switch, installed at an appropriate location of a hydraulic circuit of the internal combustion engine or of an oil pan, which generates an ON signal when the oil pressure drops below a predetermined operating point, and when the ON signal is generated, it warns the operator and controls the fuel injection amount and ignition timing so as to decrease the engine speed to a level under which the engine does not suffer from damages, such as sticking or wear due to metal-to-metal contact.

As illustrated in FIG. 11, the pressure of engine oil (lubricant) PO varies with the engine speed NE and the oil temperature TO. In the figure, a straight line indicated as "TOL" illustrates the characteristic of oil pressure under low oil temperature, while another straight line indicated as "TOH" shows that of under high oil temperature. As will be seen from the figure, the oil pressure PO decreases with decreasing engine speed NE.

In the conventional oil pressure warning system, a single oil pressure switch is used and generates an ON signal when the oil pressure drops below a predetermined point of operation (illustrated as "POx" in the figure) to alarm the occurrence of an engine oil abnormality, i.e., insufficient oil pressure. However, even if the oil pressure falls below POx, the oil pressure is still sufficient in the hatched portion (below the engine speed NEx and above the high pressure characteristic TOH). Thus, the conventional oil pressure warning system can not detect the oil pressure abnormality in the low engine speed region.

When the amount of oil is, in fact, extremely insufficient due to leakage, insufficient replenishment, etc., prompt notification is necessary. However, the output of the oil pressure switch remains unchanged until the engine speed drops below a certain level for the reason mentioned above. On the other hand, assuming that the operating point of the oil pressure switch is shifted to a lower pressure, it would become impossible to detect the oil pressure abnormality at a high engine speed.

Further, as illustrated in the figure, the characteristics are different for different oil temperatures. Since the oil viscosity decreases with increasing oil temperature, the characteristic under high temperature is lower than that under low temperature when the engine speed NE is the same. Since, however, no attention is paid for the oil pressure relative to temperature in determining the operating point of the oil pressure switch in the conventional system, when the oil pressure drops due to the oil temperature increases, the detection and alarming may sometimes be made erroneously in the conventional system.

Thus, the conventional oil pressure warning system leaves much to be improved.

SUMMARY OF THE INVENTION

An object of the present invention is therefore to solve the aforesaid problems by providing an oil pressure warning system for outboard motor, which can detect and trigger an alarm for the occurrence of an abnormality in the oil pressure accurately under any engine speed and oil temperature, such that the engine is reliably prevented from being damaged.

For realizing this object, the invention provides a warning system for oil pressure supplied to an internal combustion engine installed in an outboard motor, comprising: a first oil pressure switch installed in the engine which generates an output when the oil pressure is less than or equal to a first predetermined oil pressure; a second oil pressure switch installed in the engine which generates an output when the oil pressure is less than or equal to a second predetermined oil pressure set higher than the first predetermined oil pressure; oil pressure abnormality determining means for determining whether the oil pressure is abnormal based on at least one of the outputs of the first and second pressure switches; and alarming means for alarming when the oil pressure is determined to be abnormal.

DETAILED DESCRIPTION OF THE PREFERRED EMBODIMENT

An oil pressure warning system for an outboard motor according to an embodiment of the present invention will now be explained with reference to the attached drawings.

Figure 1:
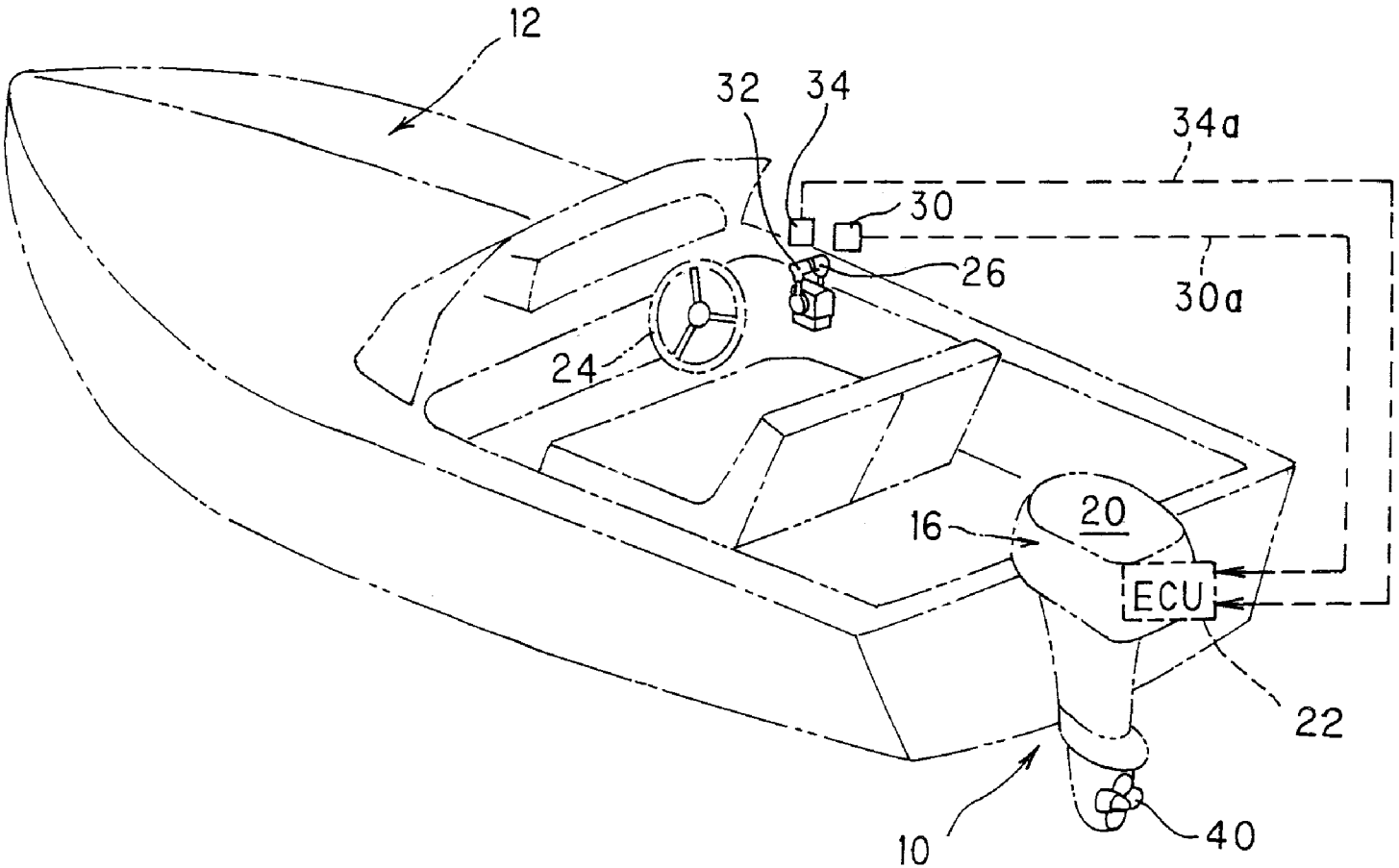
FIG. 1 is a schematic view showing the overall configuration of the oil pressure warning system for an,outboard motor according to an embodiment of the present invention.
Figure 2:
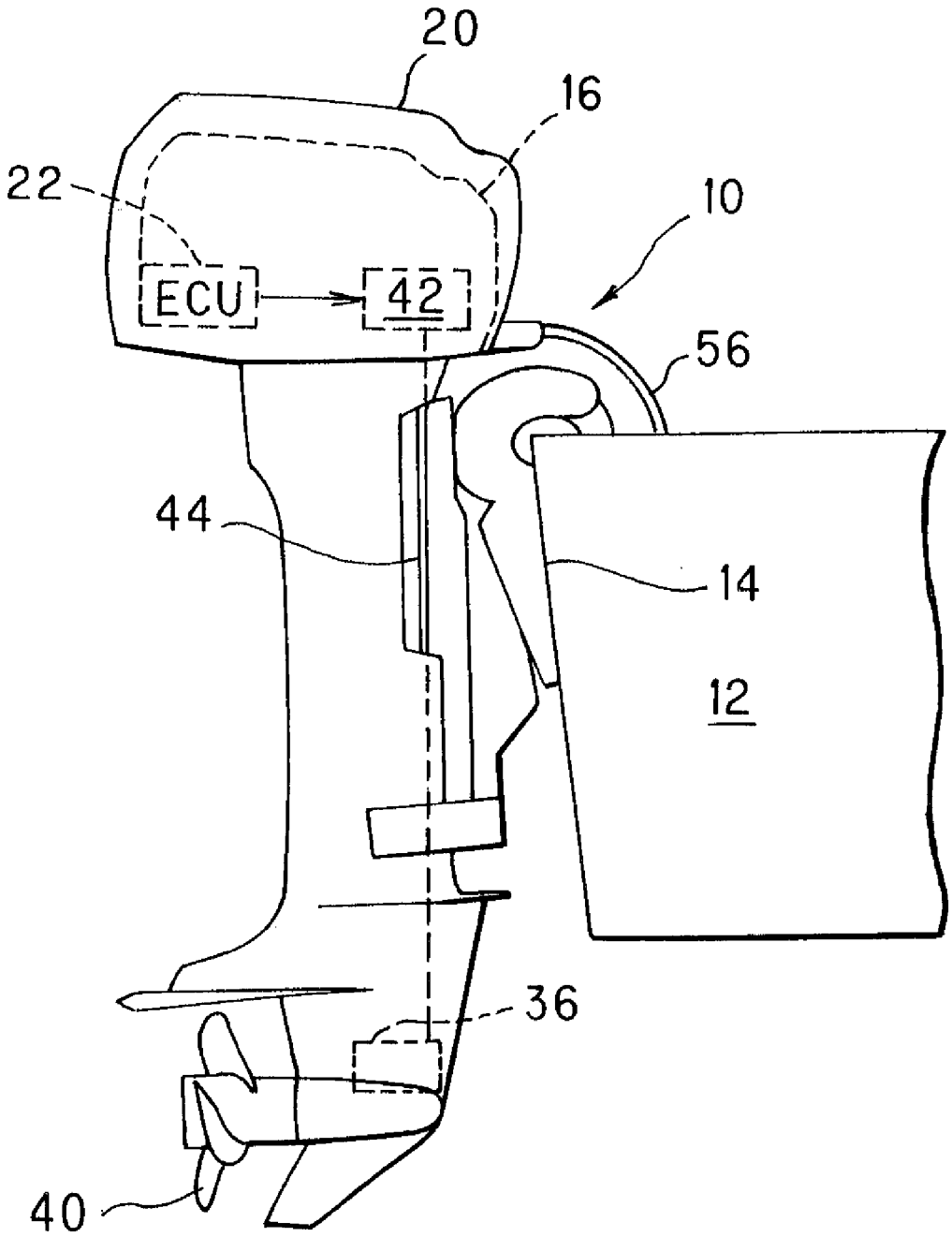
FIG. 2 is an enlarged side view of one portion of FIG. 1.

FIG. 1 is a schematic view showing the overall configuration of the oil pressure warning system for an outboard motor and FIG. 2 is an enlarged side view of one portion of FIG. 1.

Reference numeral 10 in FIGS. 1 and 2 designates a propulsion unit including an internal combustion engine, propeller shaft and propeller integrated into what is hereinafter called an "outboard motor." The outboard motor 10 is mounted on the stern of a boat (small craft) 12 by a clamp unit 14 (shown in FIG. 2).

As shown in FIG. 2, the outboard motor 10 is equipped with the internal combustion engine (hereinafter simply called the "engine") 16. The engine 16 is a spark-ignition V-6 gasoline engine. The engine is positioned above the water surface and is enclosed by an engine cover 20 of the outboard motor 10. An electronic control unit (ECU) 22 composed of a microcomputer is installed near the engine 16 enclosed by the engine cover 20.

As shown in FIG. 1, a steering wheel 24 is installed in the cockpit of the boat 12. When the operator turns the steering wheel 24, the rotation is transmitted to a rudder (not shown) fastened to the stern through a steering system not visible in the drawings, changing the direction the boat advances.

A throttle lever 26 is mounted on the right side of the cockpit and near it is mounted a throttle lever position sensor 30 that outputs a signal corresponding to the position of the throttle lever 26 set by the operator. A shift lever 32 is provided adjacent to the throttle lever 26, and next to it is installed a neutral switch 34 that outputs an ON signal when the operator puts the shift lever 32 in Neutral and outputs an OFF signal when the operator puts the shift lever 32 in Forward or Reverse. The outputs from the throttle lever position sensor 30 and neutral switch 34 are sent to the ECU 22 through signal lines 30*a* and 34*a*.

The output of the engine 16 is transmitted through a crankshaft and a drive shaft (neither shown) to a clutch 36 of the outboard engine 10 located below the water surface. The clutch 36 is connected to a propeller 40 through a propeller shaft (not shown).

The clutch 36, which comprises a conventional gear mechanism, is omitted from the drawing. It is composed of a drive gear that rotates unitarily with the drive shaft when the engine 16 is running, a forward gear, a reverse gear, and a dog (sliding clutch) located between the forward and reverse gears that rotates unitarily with the propeller shaft. The forward and reverse gears are engaged with the drive gear and rotate idly in opposite directions on the propeller shaft.

The ECU 22 is responsive to the output of the neutral switch 34 received on the signal cable 34*a* for driving an actuator (electric motor) 42 via a drive circuit (not shown) so as to realize the intended shift position. The actuator 42 drives the dog through a shift rod 44.

When the shift lever 32 is put in Neutral, the engine 16 and the propeller shaft are disconnected and can rotate independently. When the shift lever 32 is put in Forward or Reverse position, the dog is engaged with the forward gear or the reverse gear and the rotation of the engine 16 is transmitted through the propeller shaft to the propeller to drive the propeller in the forward direction or the opposite (reverse) direction and thus propel the boat 12 forward or backward.

The engine 16 will now be explained with reference to FIGS. 3 and 4.

Figure 3:
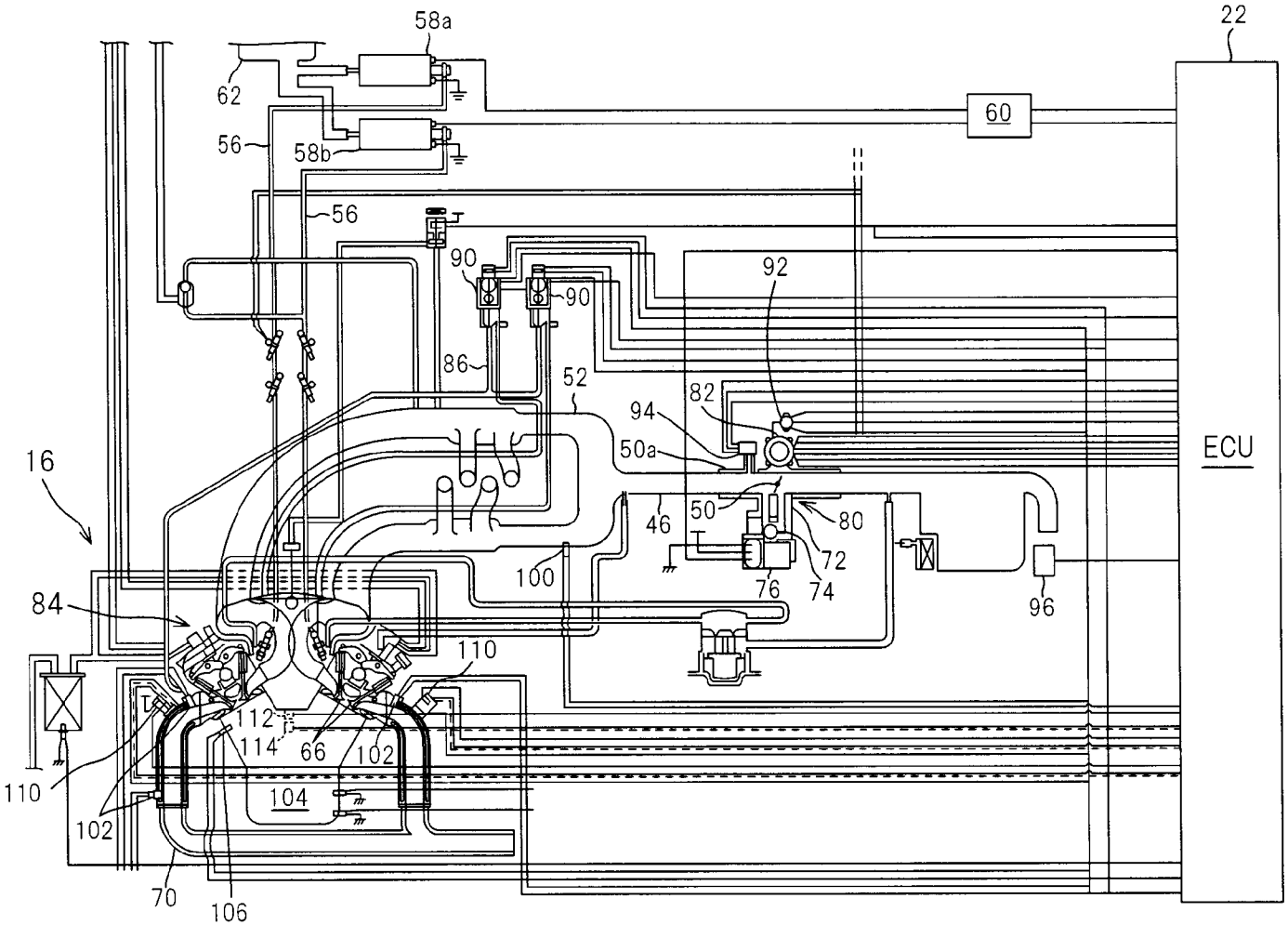
FIG. 3 is a schematic diagram showing details of the engine of the outboard motor shown in FIG. 1.

As shown in FIG. 3, the engine 16 is equipped with an air intake pipe 46. Air drawn in through an air cleaner (not shown) is supplied to intake manifolds 52 with a portion provided for each of left and right cylinder banks and disposed in V-like shape as viewed from the front, while the flow thereof is adjusted by a throttle valve 50, and finally reaches intake valves (not shown) of the respective cylinders. A fuel injector 54 (not shown in FIG. 3) is installed in the vicinity of each intake valve (not shown) for injecting fuel (gasoline).

The fuel injectors 54 are connected through two fuel pipes 56, one provided for each cylinder bank to a fuel tank (not shown) containing gasoline. The fuel pipes 56 are provided with separate fuel pumps 58*a* and 58*b* equipped with electric motors (not shown) that are driven via a relay circuit 60 so as to send pressurized gasoline to the fuel injectors 54. Reference numeral 62 designates a vaporized fuel separator.

The intake air is mixed with the injected gasoline to form an air-fuel mixture that passes into the combustion chamber (not shown) of each cylinder, where it is ignited by a spark plug 64 (not shown in FIG. 3) to bum explosively and to depress a piston (not shown). The so-produced engine output exits through exhaust valves 66 into exhaust manifolds 70, one provided for each cylinder bank, and is discharged to the exterior of the engine 16.

As illustrated in FIG. 3, a branch passage 72 for secondary air supply is formed to branch off from the air intake pipe 46 upstream of the throttle valve 50 and to rejoin the air intake pipe 46 downstream of the throttle valve 50. The branch passage 72 is equipped with an electronic secondary air control valve (EACV) 74. The EACV 74 is connected to an actuator (electromagnetic solenoid) 76. The actuator 76 is connected to the ECU 22. As explained further later, the ECU 22 calculates a current command value and supplies the same to the actuator 76 so as to drive the EACV 74 for regulating the opening of the branch passage 72. The branch passage 72, the EACV 74 and the actuator 76 thus constitute a secondary air supplier 80 for supplying secondary air in proportion to the opening of the EACV 74.

The throttle valve 50 is connected to an actuator (stepper motor) 82. The actuator 82 is connected to the ECU 22. The ECU 22 calculates a current command value proportional to the output of the throttle lever position sensor 30 and supplies it to the actuator 82 through a drive circuit (not shown) so as to regulate the throttle opening TH. More specifically, the actuator 82 is directly attached to a throttle body 50*a* housed in the throttle valve 50 with its rotating shaft (not shown) oriented to be coaxial with the throttle valve shaft. In other words, the actuator 82 is attached to the throttle body 50*a* directly, not through a linkage, so as to simplify the structure and save mounting space. Thus, in this embodiment, the push cable is eliminated and the actuator 82 is directly attached to the throttle body 50*a* for driving the throttle valve 50.

The engine 16 is provided in the vicinity of the intake valves and the exhaust valves 66 with a variable valve timing system 84. When engine speed and load are relatively high, the variable valve timing system 84 switches the valve open time and the amount of lifting to relatively large values (Hi V/T). When the engine speed and load are relatively low, it switches the valve open time and the amount of lifting to relatively small values (Lo V/T).

The exhaust system and the intake system in each bank of the engine 16 are connected by an EGR (Exhaust Gas Recirculation) pipe 86 provided therein with an EGR control valve 90. Under prescribed operating conditions, a portion of the exhaust gas is returned to the air intake system.

The actuator 82 is connected to a throttle position sensor 92 responsive to rotation of the throttle valve shaft for outputting a signal proportional to the throttle opening TH. A manifold absolute pressure sensor 94 is installed downstream of the throttle valve 50 for outputting a signal proportional to the manifold absolute pressure PBA in the air intake pipe (i. e., engine load). In addition, an atmospheric air pressure sensor 96 is installed near the engine 16 for outputting a signal proportional to the atmospheric pressure PA.

An intake air temperature sensor 100 is installed downstream of the throttle valve 50 and outputs a signal proportional to the intake air temperature TA. Three overheat sensors 102 installed in the exhaust manifolds 70 of the left and right cylinder banks output signals proportional to the engine temperature. A coolant temperature sensor 106 installed at an appropriate location near the cylinder block 104 outputs a signal proportional to the engine coolant temperature TW. $O_2$ sensors 110 are installed in the exhaust manifolds 70 and output signals reflecting the oxygen concentration of the exhaust gas.

A first oil pressure switch 112 and a second oil pressure switch 114 are installed at a hydraulic circuit (not shown) for supplying engine oil (lubricant) to the engine 16, in the vicinity of the V-bank of the engine 16 and generates ON/OFF signals, in response to the oil pressure PO in the hydraulic circuit. The outputs of the switches 112, 114 are sent to the ECU 22.

Figure 4:
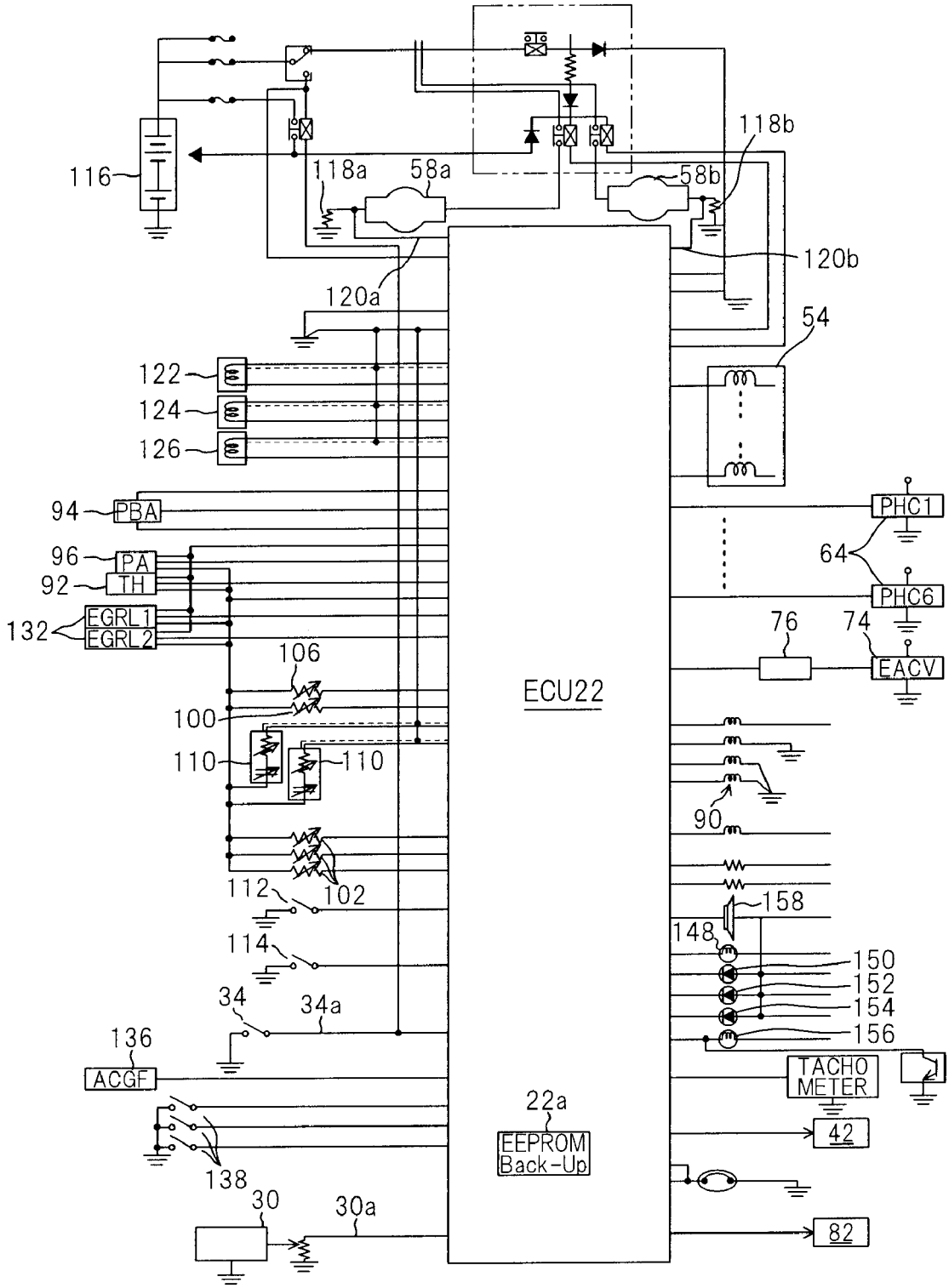
FIG. 4 is a block diagram showing the particulars of the inputs/outputs to and from an electronic control unit (ECU) shown in FIG. 1.

The explanation of the outputs of the sensors and the inputs/outputs to/from the ECU 22 will be continued with reference to FIG. 4. Some sensors and signals lines do not appear in FIG. 3.

The motors of the fuel pumps 58*a* and 58*h* are connected to an onboard battery 116 and detection resistors 118*a* and 118*b* are inserted in the motor current supply paths. The voltages across the resistors are inputted to the ECU 22 through signal lines 120*a* and 120*b*. The ECU 22 determines the amount of current being supplied to the motors from the voltage drops across the resistors and uses the result to discriminate whether any abnormality is present in the fuel pumps 58*a* and 58*b*.

TDC (Top Dead Center) sensors 122 and 124 and a crank angle sensor 126 are installed near the engine crankshaft for producing and outputting to the ECU 22 cylinder discrimination signals, crank angle signals near the top dead centers of the pistons, and a crank angle signal once every 30 degrees. The ECU 22 calculates the engine speed NE from the output of the crank angle sensor. A lift sensor 132 is installed near the EGR control valve 90 and produces and sends to the ECU 22 signals related to the amount of lifting (valve openings) of the EGR control valves 90.

The output of the F-terminal (ACGF) 136 of an AC generator (not shown) is input to the ECU 22. Three oil pressure (hydraulic) switches 138 are installed in the hydraulic circuit (not shown) of the variable valve timing system 84 and produce and output to the ECU 22 signals related to the detected oil pressure.

The ECU 22, which is composed of a microcomputer as mentioned earlier, is equipped with an EEPROM (Electrically Erasable and Programmable Read-Only Memory) 22*a* for back-up purposes. The ECU 22 uses the foregoing inputs to carry out processing operations explained later. It also turns on a PGM lamp 148 when the PGM (program/ECU) fails, an overheat lamp 150 when the engine 16 overheats, an oil pressure (hydraulic) lamp 152 when the oil pressure becomes abnormal (explained later) and an ACG lamp 154 when the AC generator fails. Together with lighting these lamps it sounds a buzzer 156.

Explanation will not be made with regard to other components appearing in FIG. 4 that are not directly related to the substance of this invention.

The operation of the oil pressure warning system for an outboard motor according to this embodiment, comprising abnormal oil pressure detection (determination) and subsequent alarming, will now be explained.

Figure 5:
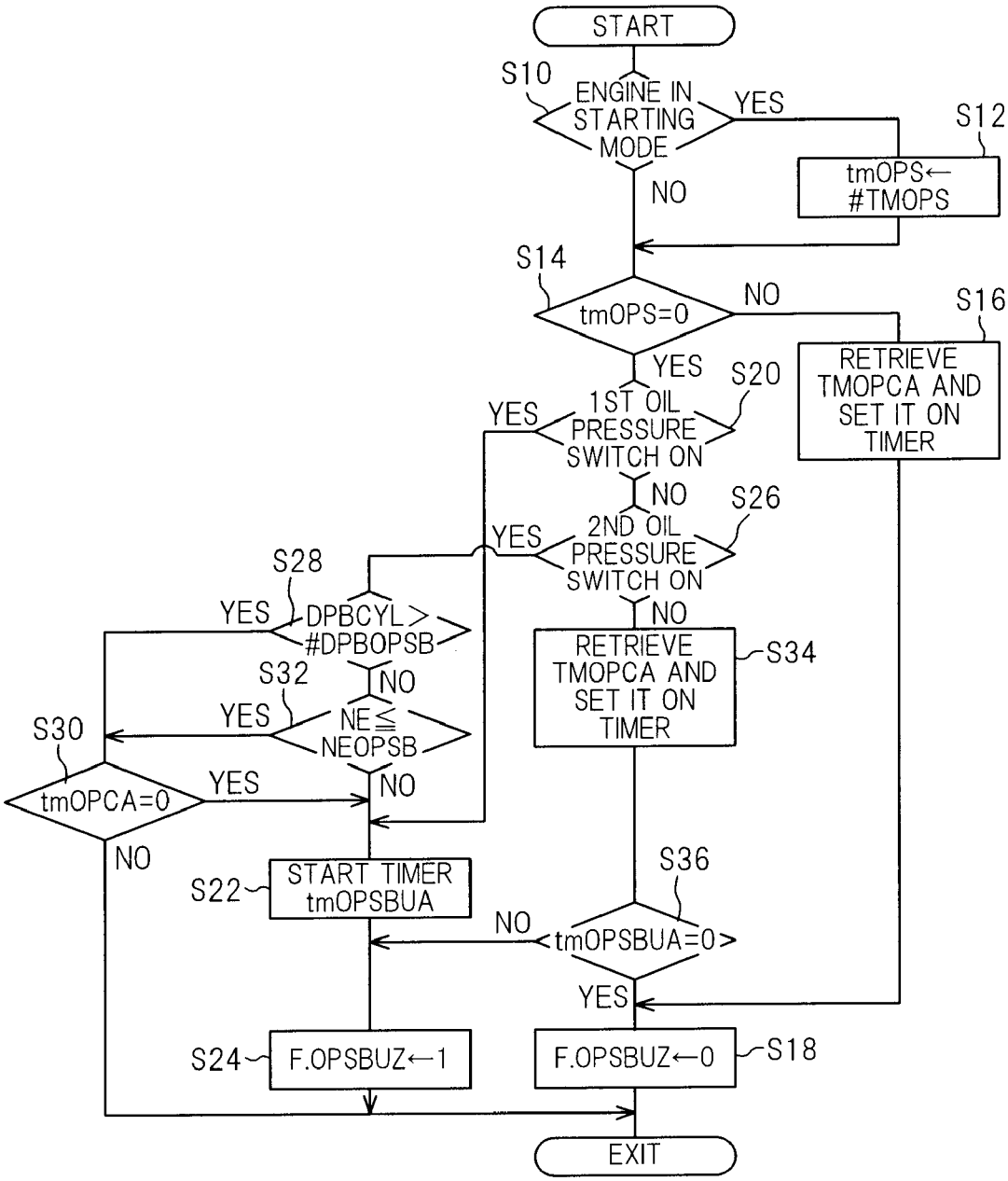
FIG. 5 is a flow chart showing the operation, i.e., the abnormal oil pressure detection of the oil pressure warning system for an outboard motor illustrated in FIG. 1.

FIG. 5 is a flow chart showing the operation of the abnormal oil pressure detection. The illustrated program is executed once every 100 msec, for example.

The program begins in S10, in which it is determined whether the engine 16 is in a starting mode (or if the engine 16 has stalled). This is done by determining whether the detected engine speed NE has reached an engine-starting speed.

When the result is affirmative, the program proceeds to S12, in which an oil-pressure-abnormality-detection cancel timer (down-counter) tmOPS is set with a prescribed value #TMOPS to start the same to begin counting down (i.e., time measurement).

When the result in S10 is negative or when the program proceeds to S12, the program then proceeds to S14, in which it is determined whether the value of the oil-pressure-abnormality-detection cancel timer tmOPS has reached zero. The timer tmOPS is provided for preventing the abnormal oil pressure detection (determination) and alarming for a predetermined period of time (corresponding to the prescribed value #TMOPS) since engine starting.

Figure 6:
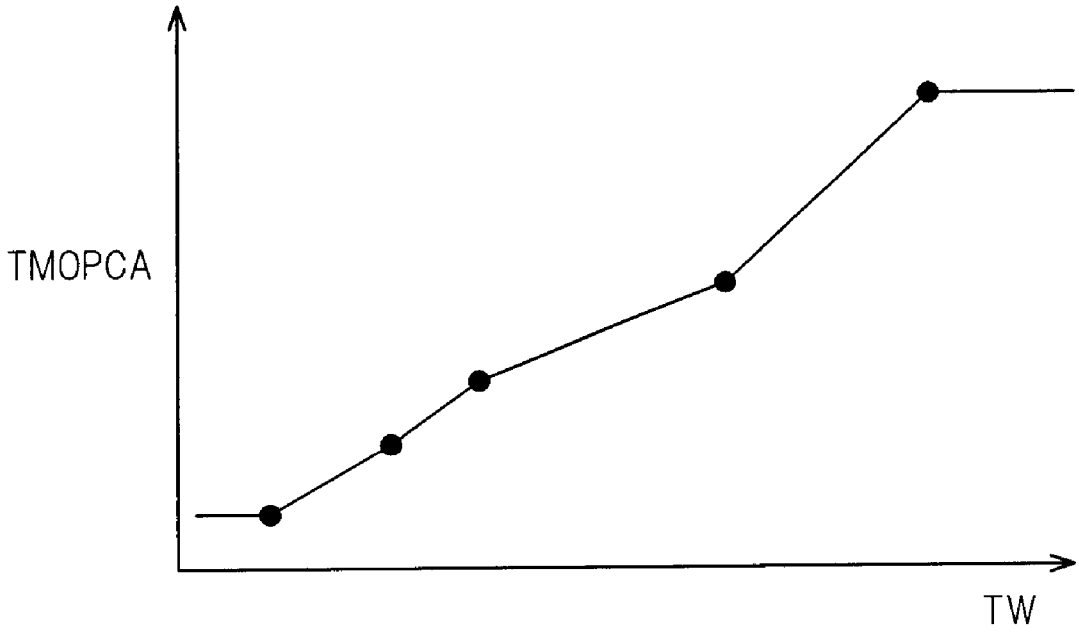
FIG. 6 is a graph showing the characteristic of a timer value TMOPCA set relative to the engine coolant temperature TW.

When the result in S14 is negative, the program proceeds to S16, in which a value TMOPCA is retrieved from a table (whose characteristic is illustrated in FIG. 6) by the detected engine coolant temperature TW, and the retrieved value is set on an oil-pressure-abnormality-determination delay timer (down-counter) tmOPCA to start the same to begin time measurement. As illustrated in FIG. 6, the value TMOPCA is set to be increased with increasing engine coolant temperature TW. The reason for this will be explained later.

The program proceeds to S18, in which the bit of a buzzer-operation-permission flag F.OPSBUZ is reset to 0, and the program is at once terminated. Resetting the bit of the flag F.OPSPUZ to 0 indicates not to operate (sound) the buzzer 156, while a setting of 1 indicates to operate as to effect alarming.

In the next or later program loop, when the result in S14 is affirmative, the program proceeds to S20, in which it is determined whether the first oil pressure switch 112 generates the ON signal.

Figure 7:
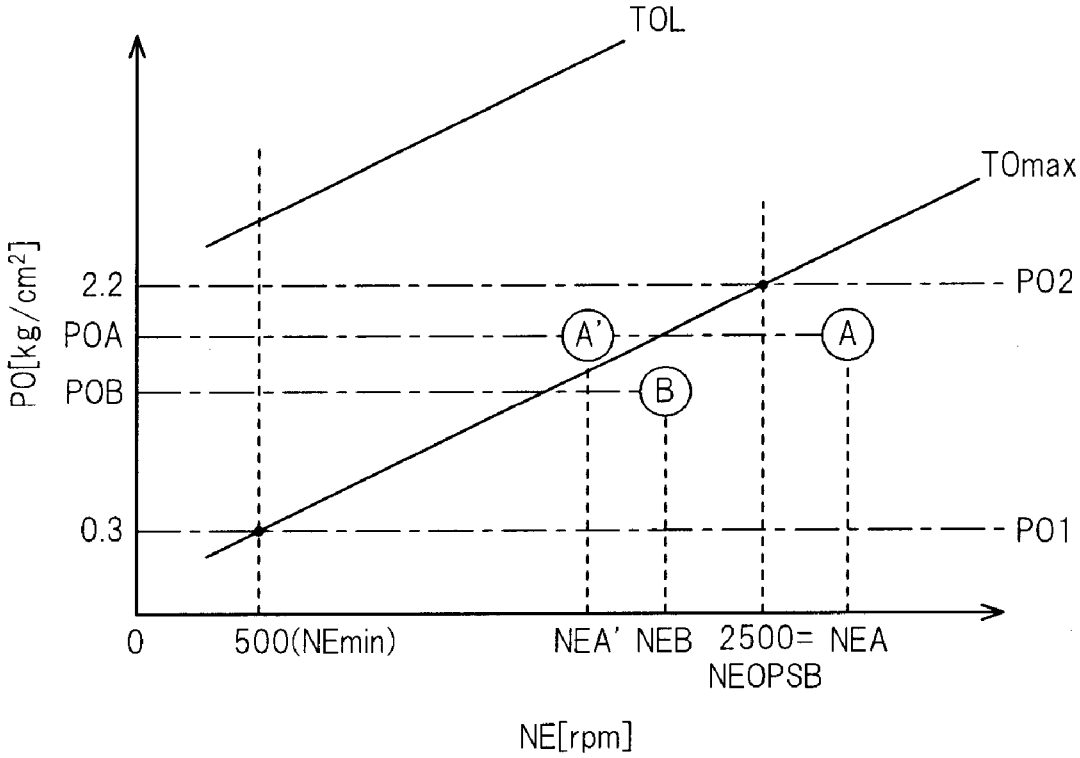
FIG. 7 is a graph showing first and second predetermined oil pressures indicative of the operating points of oil pressure switches illustrated in FIG. 3 and set relative to the characteristic of (possible) maximum oil temperature TOmax and the engine speed NE, referred to in the flow chart of FIG. 5.

Before continuing the explanation of the flow chart in FIG. 5, the operations of the first and second oil pressure switches 112, 114 will be explained with reference to FIG. 7.

In this embodiment, the first oil pressure switch 112 is configured to generate the OFF signal when the engine oil pressure PO is greater than a first predetermined oil pressure PO1 (indicating the operation point) and to generate the ON signal when the engine oil pressure PO is less than or equal to the first predetermined oil pressure PO1. The second oil pressure switch 114 is configured to generate the OFF signal when the engine oil pressure PO is greater than a second predetermined oil pressure PO2 (similarly indicating the operation point) and to generate the ON signal when the engine oil pressure PO is less than or equal to the second predetermined oil pressure PO2.

Further, as mentioned above, oil pressure drop due to oil temperature rise may lead to erroneous detection. In view of this, in this embodiment, the predetermined first and second oil pressures PO1, 2 (each indicating the operating point) are set relative to a (possible) maximum oil temperature under which the engine 16 has been completely warmed up, and, more specifically, they are set relative to a characteristic set based on a (possible) maximum oil temperature TOmax. The characteristic is set to be increased with increasing engine speed NE. This can reliably avoid erroneous detection if the engine oil pressure drops due to temperature rise.

Further, the first predetermined oil pressure PO1 is set to a value corresponding to a minimum engine speed NEmin (at or close to an idling engine speed, e.g., 500 rpm) relative to the engine speed NE in accordance with the characteristic of the maximum oil temperature TOmax. Specifically, the first predetermined oil pressure PO1 is set to be 0.3 kg/cm2. In other words, the first predetermined oil pressure PO1 is set to be a (possible) minimum oil pressure under normal operating conditions of the engine 16. With this, it becomes possible to promptly detect an abnormal oil decrease due to leakage, insufficient replenishment, etc.

Further, the second predetermined oil pressure PO2 is set to a value corresponding to a full load (at high engine speed and with a large engine load). Specifically, the second predetermined, oil pressure PO2 is set to a value corresponding to a high engine speed (more precisely, 2500 rpm) relative to the engine speed NE in accordance with the characteristic of maximum oil temperature Tomax. More specifically, it is set to be 2.2 kg/cm$^2$. With this, it becomes possible to detect the abnormal oil pressure at a high engine speed and with a large engine load, thereby ensuring protection of the engine 16 against damage by sticking or wear due to metal-to-metal contact.

Returning to the explanation of the flow chart of FIG. 5, when the result in S20 is affirmative, since this indicates the oil pressure became abnormal (low), the program proceeds to S22, in which a prescribed value is set on a buzzer-operation-termination timer (down-counter) tmOPSBUA to start time measurement, to S24 in which the bit of the buzzer-operation-permission flag F.OPSBUZ is set to 1 to operate (sound) the buzzer 156 and to turn the lamp 152 on so as to effect alarming. At the same time, the oil pressure lamp is turned on. Then, the program is at once terminated.

On the other hand, when the result in S20 is negative, the program proceeds to S26, in which it is determined whether the second oil pressure switch 114 generates the ON signal, in other words, it is determined whether the oil pressure PO is less than or equal to the second predetermined oil pressure PO2. When the result is affirmative, the program proceeds to S28, in which a change DPBCYL of the manifold absolute pressure PBA is greater than a predetermined amount #DPBOPSB. The change DPBCYL indicates the difference between the manifold absolute pressure PBA detected at the last cycle (last program loop) and that detected at the current cycle (program loop).

Figure 8:
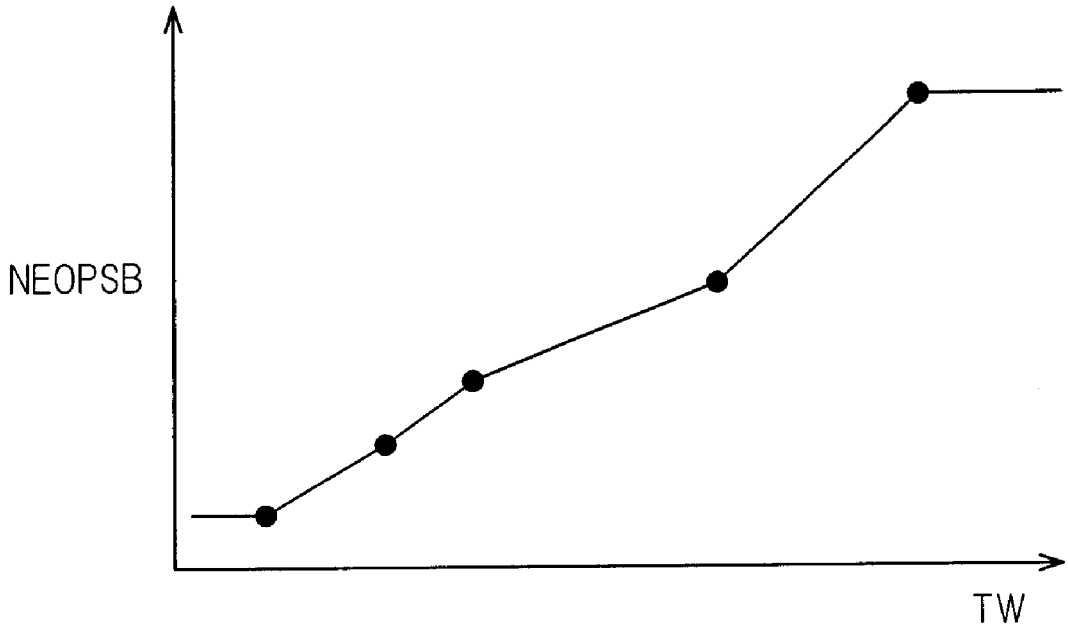
FIG. 8 is a graph showing a predetermined engine speed NEOPSB set relative to the engine coolant temperature and referred to in the flow chart of FIG. 5.

When the result in S28 is affirmative, since this indicates that the engine 16 is under transient operating conditions, the program proceeds to S30, in which it is determined whether the value of the oil-pressure-abnormality-determination delay timer tmOPCA has reached zero. On the other hand, when the result in S28 is negative, since this indicates that the engine 16 is operating under normal conditions, such as cruising, the program proceeds to S32, in which it is determined whether the detected engine speed NE is less than or equal to a predetermined engine speed NEOPSB. FIG. 8 shows the characteristic of the predetermined engine speed NEOPSB. As illustrated, the speed NEOPSB is set to increase with increasing engine coolant temperature TW and is calculated by retrieving a table (prepared beforehand based on this illustrated characteristic) using the detected engine coolant temperature TW.

The oil temperature TO rises as the engine speed NE increases. Since the engine coolant temperature TW rises in this situation also, the relationship between the engine speed NE and the oil temperature TO can accordingly be replaced by a relationship between the engine speed NE and the engine coolant temperature TW. Further, as illustrated in FIG. 7, there exists a certain proportional relationship between the engine speed NE and the oil pressure PO.

Thus, it becomes possible to accurately determine whether the oil pressure PO is low even at an engine speed region below the engine speed NEOPSB (based on which the second predetermined oil pressure PO2 is set), by comparing the detected engine speed NE with the engine speed NEOPSB (which is predetermined with respect to the detected engine coolant temperature TW).

The determination in S32 will further be explained with reference to FIG. 7.

If the oil pressure PO is less than the second predetermined oil pressure PO2 when the oil temperature TO is at the maximum oil temperature TOmax (i.e., if the result in S26 is affirmative) and the detected engine speed NE is NEA (marked by "A" in the figure) which is higher than the engine speed NEOPSB (2500 rpm, for example), the result in S32 is negative, and since this indicates the oil pressure is low, the program proceeds to S22, in which the timer tmOPSBUA is set with a prescribed value to start time measurement, and to S24, in which the bit of the flag F.OPSBUZ is set to I to operate (sound) the buzzer 156 to effect alarming.

Alternatively, if the oil pressure PO is similarly less than the second predetermined oil pressure PO2 when the oil temperature TO is at the maximum oil temperature TOmax (i.e., if the result in S26 is affirmative), but the detected engine speed NE is less than the engine speed NEOPSB (as marked by "A" and "B" in the figure), the result in S32 is affirmative and the program proceeds to S30, in which it is determined whether the value of the timer tmOPCA has reached zero. Unless the result is affirmative, the program is immediately terminated and the following procedures are skipped.

Thus, the timer tmOPCA is configured such that the oil pressure is determined to be abnormal (i.e., low) only when the output state of the second oil pressure switch 114 is kept unchanged for a predetermined period (corresponding to the value TMOPCA). With this, as illustrated in a time chart shown in FIG. 9, if the oil pressure PO temporarily drops below the second predetermined oil pressure PO2, a transient situation as such will not be detected as abnormal, thereby reliably avoiding the audio alarming of the buzzer 156 and the implementation of the oil pressure alarming explained below.

When the result in S30 is affirmative, since this indicates that the oil pressure is determined to be abnormal (low), the program proceeds to S22 and S24.

Further, another situation where the oil pressure PO is less than the second predetermined oil pressure PO2 due to a decrease in engine speed, but is still the characteristic of TOmax (not abnormal) as marked by "A1" in the figure, or still another situation where the oil pressure PO is less than PO2 and is abnormal (low) as marked by "B" in the figure, will be explained.

The change of the oil pressure PO lags behind the change of the engine speed NE. Specifically when the engine speed NE drops, the oil pressure PO drops also. Since, however, the oil temperature TO will drop due to the engine speed decrease, the oil pressure PO will then increase. In this case, since the oil pressure returns to a high level and hence the result in S26 becomes negative, the program does not proceed to S30 and hence, the oil pressure PO will not be determined to be abnormal. On the other hand, when the oil pressure PO is, in fact, abnormal (low), since it will not return to a sufficient level, the oil pressure PO will be determined to be abnormal when the result in S30 becomes affirmative.

In this embodiment, as mentioned above, the oil pressure is immediately determined to be abnormal (low) from the output (ON signal) of the second oil pressure switch 114, when it can be judged from the manifold absolute pressure PBA and the engine speed NE that the oil pressure is abnormal, while the determination is delayed, until the output of the switch 114 is kept unchanged for a predetermined period (corresponding to the timer value TMOPCA) when the oil pressure is likely to return to a sufficient state. With this, it becomes possible to accurately detect and alarm the abnormality in the oil pressure at all engine speeds and oil temperatures, thereby ensuring that engine sticking or wear due to metal-to-metal contact will be avoided.

Furthermore, the timer value TMOPCA is set to be increased with increasing engine coolant temperature TW as illustrated in FIG. 6. This is because the oil pressure PO drops as the engine coolant temperature TW (and hence the oil temperature TO) increases and a period of time necessary for the oil pressure to return to the second predetermined oil pressure PO2 increases as the engine coolant temperature TW increases. By setting the characteristic of the timer value as shown in FIG. 6, the erroneous detection can be avoided more reliably.

Returning to the explanation of the flow chart of FIG. 5, when the result in S26 is negative, since this indicates that the oil pressure PO is not low, the program proceeds to S34, in which the value TMOPCA is retrieved and is set on the timer tmOPCA to start time measurement. The program then proceeds to S36, in which it is determined whether the value of the buzzer-operation-termination timer tmOPSBUA has reached zero. The buzzer-operation-termination timer tmOPSBUA is thus configured such that the oil pressure is determined to be not abnormal when the non-abnormal state is kept unchanged for the predetermined period (corresponding to TMOPCA). This can avoid erroneous detection in a situation where the oil pressure PO exceeds temporarily the second predetermined oil pressure PO2 for a short period of time, as illustrated in the time chart of FIG. 9.

When the result in S36 is negative, the program proceeds to S24, in which the operation of the buzzer 156, i.e., the audio alarming, is continued. On the other hand, when the result in S36 is affirmative, the program proceeds to S18, in which the bit of the buzzer-operation-permission flag F.OPSBUZ is reset to 0 such that the operation of the buzzer 156 is terminated.

Next, another operation of the oil pressure warning system for an outboard motor according to this embodiment, i.e., alarming after the abnormality detection, will be explained.

Figure 10:
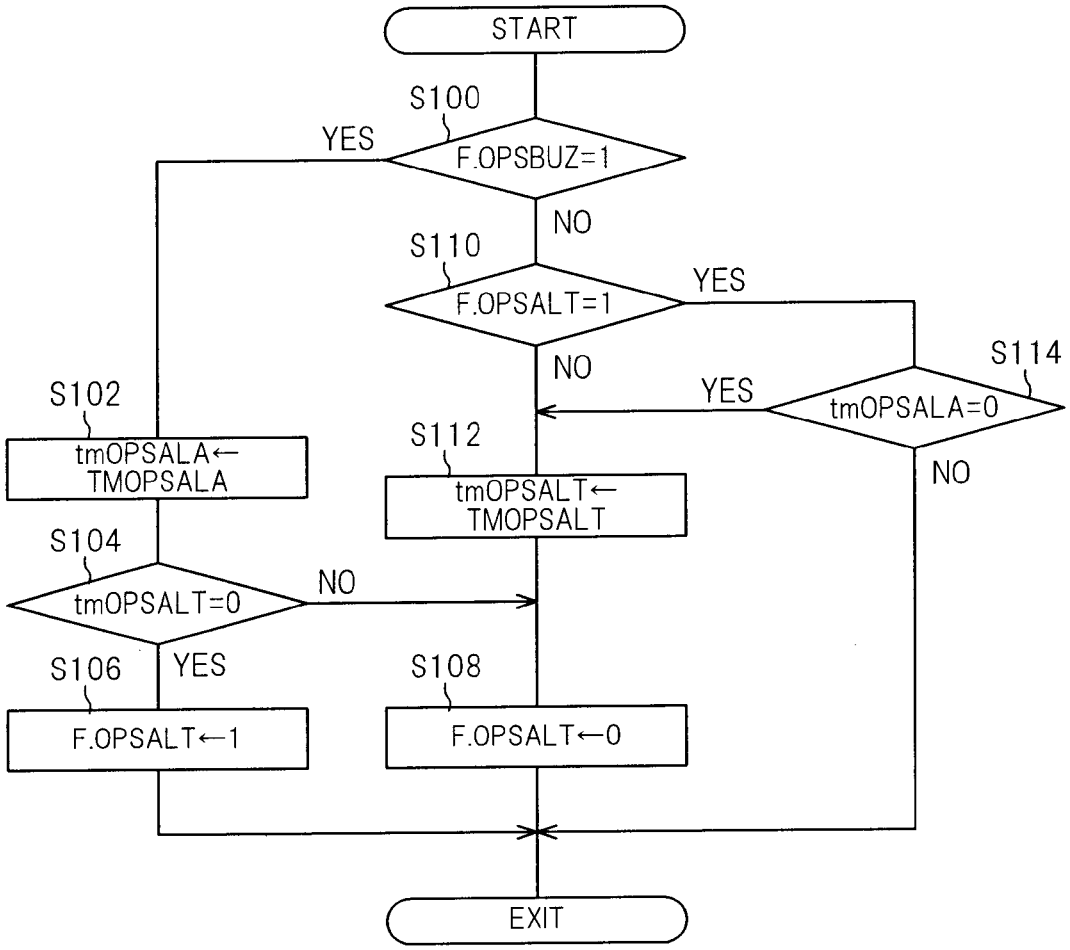
FIG. 10 is a flow chart showing the operation, i.e., the abnormal oil pressure alarming of the oil pressure warning system for an outboard motor illustrated in FIG. 1.
Figure 11:
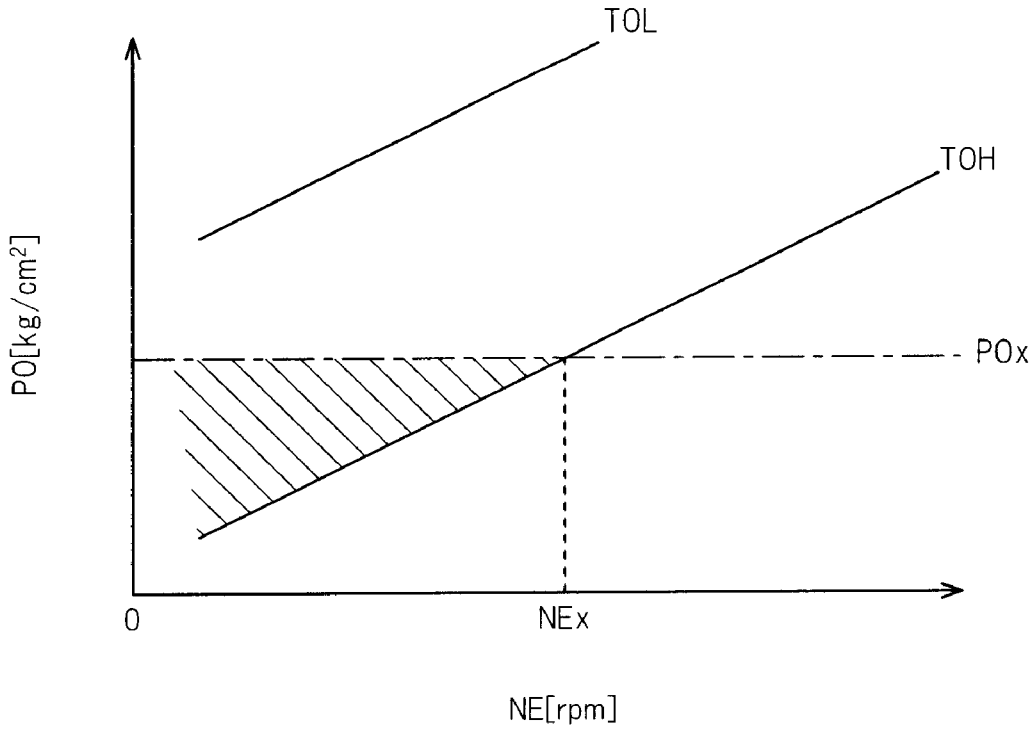
FIG. 11 is a graph, similar to FIG. 7, but showing a predetermined oil pressure indicative of the operating point of an oil pressure switch in a conventional oil pressure warming system for an outboard motor.

FIG. 10 is a flow chart showing the alarming after the oil pressure abnormality detection, which also constitutes the operation of the oil pressure warning system for an outboard motor according to this embodiment. The illustrated program is similarly executed once every 100 msec, for example.

The program begins in S100, in which it is determined whether the bit of the buzzer-operation-permission flag F.OPSBUZ is set to 1, and when the result is affirmative, since this indicates that the oil pressure is abnormal, the program proceeds to S102, in which a prescribed value TMOPSALA is set on an oil-pressure-alarm-return-delay timer tmOPSALA (explained later) to start the same.

The program then proceeds to S104, in which it is determined whether a value of an oil-pressure-alarm-execution-delay timer tmOPSALT has reached zero. The timer is started at a step explained below and is a counter (down-counter) to count down or measure a time interval from the buzzer operation (oil pressure abnormality determination) to the initiation of "DECREASING" of the engine speed (illustrated in the time chart of FIG. 9).

When the result in S104 is affirmative, the program proceeds to S106, in which the bit of an oil-pressure-alarm-permission flag F.OPSALT is set to 1 to execute the oil pressure alarming. Setting the bit of the flag F.OPSALT to 1 indicates to execute the oil pressure alarming, while resetting it to 0 does not indicate to execute the oil pressure alarming. When the result in S104 is negative, the program proceeds to S108, in which the bit of the flag F.OPSALT is reset to 0.

On the other hand, when the result in S100 is negative, the program proceeds to S110, in which it is determined whether the bit of the flag F.OPSALT is set to 1. When the result is negative, the program proceeds to S112, in which the prescribed value TMOPSALT is set on the timer tmOPSALT to start the same, and the program proceeds to S108. When the result in S110 is affirmative, the program proceeds to S114, in which it is determined whether the value of the timer tmOPSALA has reached zero. The timer is a counter (down-counter) to count down or measure a time interval from the termination of buzzer operation (i.e., the oil pressure abnormality is eliminated) to the initiation of "RETURNING" of the engine speed (illustrated in the time chart of FIG. 9). When the result in S114 is affirmative, the program proceeds to S112. When the result in S114 is negative, the program is immediately terminated.

Figure 9:
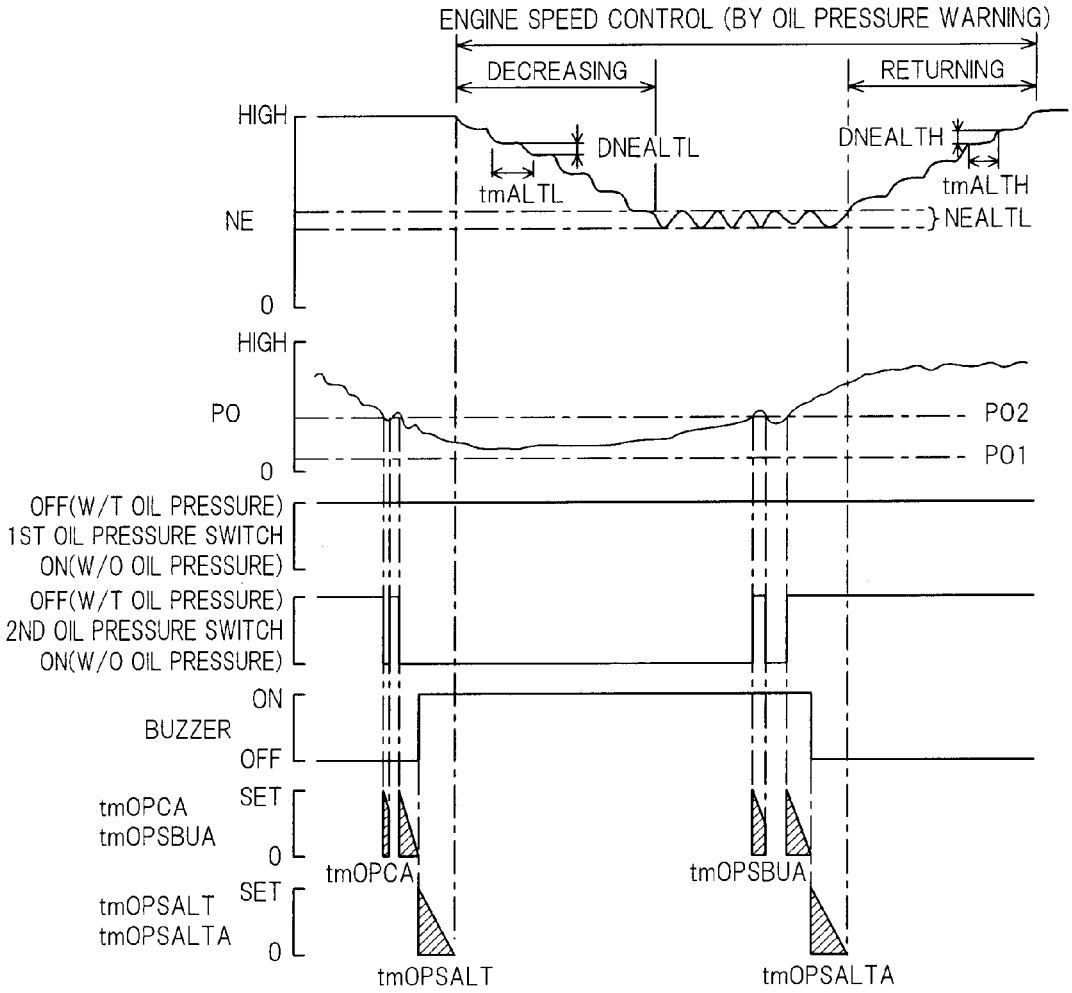
FIG. 9 is a time chart showing the processing in the flow chart of FIG. 5.

This oil pressure alarming will again be explained with reference to the time chart of FIG. 9.

When the bit of the flag F.OPSALT is set to 1, the engine speed decreasing control is conducted in a routine (not shown) by cutting off the fuel supply and ignition to the engine 16 such that the engine speed NE decreases stepwise by a prescribed amount DNEALTL at every unit period of time tmALTL. When the engine speed has dropped to a predetermined engine speed NEALTL at which the engine 16 is not likely to be damaged due to metal-to-metal contact, the engine speed NE is kept at this speed NEALTL until the bit of the flag F.OPSALT is reset to 0.

When the bit of the flag F.OPSALT is reset to 0, the control is shifted to a mode of engine speed returning (increasing) in which the engine speed NE is increased stepwise to a level required by the operator by a prescribed amount DNEALTH at every unit period of time tmALTH.

Having been configured in the foregoing manner, in the system according to the embodiment, since the operating points (the aforesaid first and second predetermined oil pressures PO1, PO2) of the first and second oil pressure switches 114 and 116 are set relative to the oil pressure characteristic at the (possible) maximum oil temperature TOmax (under which the engine 16 has been sufficiently warmed up), the system does not misjudge the oil pressure drop due to oil temperature rise as the abnormal oil pressure.

Further, since the first predetermined oil pressure PO1 is set to a lowest pressure possibly experienced under normal operating condition of the engine 16, the system can detect the abnormal oil pressure, without fail, caused by leakage of oil, insufficient replenishment of oil, etc. On the other hand, since the second predetermined oil pressure PO2 is set to a level under full engine load, the system can detect the abnormal oil pressure under high engine load and high engine speed, thereby enabling the reliable prevention of the engine 16 from being damaged by metal-to-metal contact.

Further, since the detected engine speed NE is compared with the predetermined engine speed NEOPSB (variable with the engine coolant temperature TW), the system can detect the abnormal oil pressure at an engine speed not more than the engine speed based on which the second predetermined oil pressure is set.

Further, since the oil pressure is immediately determined to be abnormal (low) from the output of the second oil pressure switch 114, when it can be judged from the manifold absolute pressure PBA and the engine speed NE that the oil pressure is abnormal, while the determination is delayed until the output of the switch 114 is kept unchanged for the predetermined period (corresponding to the timer value TMOPCA) when the oil pressure may return to a sufficient state, the system can detect and activate the alarm indicating the abnormality in the oil pressure more accurately.

Further, since the timer value TMOPCA is set to be increased with increasing engine coolant temperature TW, it can reliably avoid erroneous detection .

The embodiment is thus configured to have a system for the warning of undesired oil pressure in an internal combustion engine (16) installed in an outboard motor (10), comprising: a first oil pressure switch (112) installed in the engine which generates an output when the oil pressure (PO) is less than or equal to a first predetermined oil pressure (PO1); a second oil pressure switch (114) installed in the engine which generates an output when the oil pressure is less than or equal to a second predetermined oil pressure (PO2) set higher than the first predetermined oil pressure; oil pressure abnormality determining means (ECU 22, S10–S36) for determining whether the oil pressure is abnormal based on at least one of the outputs of the first and second pressure switches; and alarming means (ECU 22, oil pressure lamp 152, buzzer 156, S24, S100–Si 14) for alarming when the oil pressure is determined to be abnormal.

In the system, at least one of the first and second predetermined oil pressures is set based on an oil pressure characteristic (of a (possible) maximum oil temperature TOmax) under which the engine has been warmed up.

In the system, the oil pressure characteristic is set relative to an engine speed (NE) such that it is increased with increasing engine speed.

In the system, the first predetermined oil pressure is set to a value corresponding to a first engine speed (NEmin) at which the engine idles.

In the system, the second predetermined oil pressure is set to a value corresponding to a second engine speed which is higher than the first engine speed.

In the system, the oil pressure abnormality determining means determines whether the oil pressure is abnormal from the output of the second pressure switch based on at least one of the engine speed (S32) and an engine load (S28).

In the system, the oil pressure abnormality determining means determines that the oil pressure is abnormal if the second oil pressure switch generates the output when a change (DPBCYL) of the engine load is greater than a predetermined value (#DPBOPSB).

In the system, the oil pressure abnormality determining means determines that the oil pressure is abnormal if the second oil pressure switch generates the output continuously for a predetermined period (TMOPCA) when the change of the engine load is greater than the predetermined value (S30).

In the system, the predetermined period is set to be increased with increasing engine coolant temperature (TW).

In the system, the oil pressure abnormality determining means determines that the oil pressure is abnormal if the second oil pressure switch generates the output when a change of the engine load is not greater than a predetermined value (S28) and the engine speed is less than or equal to a predetermined speed (NEOPSB; S32).

In the system, the oil pressure abnormality determining means determines that the oil pressure is abnormal if the second oil pressure switch generates the output for a predetermined period (TMOPCA; S30) when the change of the engine load is not greater than the predetermined value (S28) and the engine speed is less than or equal to the predetermined speed (S32).

In the system, the predetermined engine speed (NEOPSB) is set to be increased with increasing engine coolant temperature (TW).

In the system, the predetermined period (TMOPCA) is set to be increased with increasing engine coolant temperature (TW).

Although the invention was explained with reference to an embodiment of an outboard motor, the invention is not limited in application to an outboard motor but can also be applied to an inboard motor.

The entire disclosure of Japanese Patent Application No. 2000-260784 filed on Aug. 30, 2000, including specification, claims, drawings and summary, is incorporated herein in reference in its entirety.

While the invention has thus been shown and described with reference to specific embodiments, it should be noted that the invention is in no way limited to the details of the described arrangements but changes and modifications may be made without departing from the scope of the appended claims.

What is claimed is:

1. A system for warning of abnormal oil pressure supplied to an internal combustion engine installed in an outboard motor, comprising:

a first oil pressure switch installed in the engine which generates an output when the oil pressure is less than or equal to a first predetermined oil pressure;

a second oil pressure switch installed in the engine which generates an output when the oil pressure is less than or equal to a second predetermined oil pressure set higher than the first predetermined oil pressure;

oil pressure abnormality determining means for determining whether the oil pressure is abnormal based on the outputs of the first and second pressure switches, and alarming means for alarming when the oil pressure is determined to be abnormal, wherein the first and second predetermined oil pressures are set based on oil pressure characteristics under which the engine has been warmed up;

and wherein the oil pressure characteristics are set relative to an engine speed such that it is increased with increasing engine speed.

2. A system according to claim 1, wherein the first predetermined oil pressure is set to a value corresponding to a first engine speed at which the engine idles.

3. A system according to claim 1, wherein the second predetermined oil pressure is set to a value corresponding to a second engine speed which is higher than the first engine speed.

4. A system according to claim 3, wherein the oil pressure abnormality determining means determines whether the oil pressure is abnormal from the output of the second pressure switch based on at least one of the engine speed and an engine load.

5. A system according to claim 4, wherein the oil pressure abnormality determining means determines that the oil pressure is abnormal if the second oil pressure switch generates the output when a change of the engine load is greater than a predetermined value.

6. A system according to claim 5, wherein the oil pressure abnormality determining means determines that the oil pressure is abnormal if the second oil pressure switch generates the output continuously for a predetermined period when the change of the engine load is greater than the predetermined value.

7. A system according to claim 6, wherein the predetermined period is set to be increased with increasing engine coolant temperature.

8. A system according to claim 4, wherein the oil pressure abnormality determining means determines that the oil pressure is abnormal if the second oil pressure switch generates the output when a change of the engine load is not greater than a predetermined value and the engine speed is less than or equal to a predetermined speed.

9. A system according to claim 8, wherein the oil pressure abnormality determining means determines that the oil pressure is abnormal if the second oil pressure switch generates the output for a predetermined period when the change of the engine load is not greater than the predetermined value and the engine speed is less than or equal to the predetermined speed.

10. A system according to claim 9, wherein the predetermined period is set to be increased with increasing engine coolant temperature.

11. A system according to claim 8, wherein the predetermined engine speed is set to be increased with increasing engine coolant temperature.

12. A method of warning of abnormal oil pressure supplied to an internal combustion engine installed in an outboard motor, comprising the steps of:

(a) generating a first signal when the oil pressure is less than or equal to a first predetermined oil pressure;

(b) generating a second signal when the oil pressure is less than or equal to a second predetermined oil pressure set higher than the first predetermined oil pressure;

(c) determining whether the oil pressure is abnormal based on the first and second signals, and (d) alarming when the oil pressure is determined to be abnormal, wherein of the first and second predetermined oil pressures are set based on oil pressure characteristics under which the engine has been warmed up;

and wherein the oil pressure characteristics are set relative to an engine speed such that it is increased with increasing engine speed.

13. A method according to claim 12, wherein the first predetermined oil pressure is set to a value corresponding to a first engine speed at which the engine idles.

14. A method according to claim 12, wherein the second predetermined oil pressure is set to a value corresponding to a second engine speed which is higher than the first engine speed.

15. A method according to claim 14, wherein the step (c) determines whether the oil pressure is abnormal from the second signal based on at least one of the engine speed and an engine load.

16. A method according to claim 15, wherein the step (c) determines that the oil pressure is abnormal if the step (b) generates the second signal when a change of the engine load is greater than a predetermined value.

17. A method according to claim 16, wherein the step (c) determines that the oil pressure is abnormal if the step (b) generates the second signal continuously for a predetermined period when the change of the engine load is greater than the predetermined value.

18. A method according to claim 17, wherein the predetermined period is set to be increased with increasing engine coolant temperature.

19. A method according to claim 15, wherein the step (c) determines that the oil pressure is abnormal if the step (b) generates the second signal when a change of the engine load is not greater than a predetermined value and the engine speed is less than or equal to a predetermined speed.

20. A method according to claim 19, wherein the step (c) determines that the oil pressure is abnormal if the step (b) generates the second signal for a predetermined period when the change of the engine load is not greater than the predetermined value and the engine speed is less than or equal to the predetermined speed.

21. A method according to claim 20, wherein the predetermined period is set to be increased with increasing engine coolant temperature.

22. A method according to claim 19, wherein the predetermined engine speed is set to be increased with increasing engine coolant temperature.

* * * * *